US011854492B1

(12) United States Patent
Zheng et al.

(10) Patent No.: US 11,854,492 B1
(45) Date of Patent: Dec. 26, 2023

(54) DATA DRIVER AND DISPLAY DEVICE

(71) Applicant: WUHAN CHINA STAR OPTOELECTRONICS SEMICONDUCTOR DISPLAY TECHNOLOGY CO., LTD., Hubei (CN)

(72) Inventors: Jinlong Zheng, Hubei (CN); Qiang Zang, Hubei (CN); Chunsheng Li, Hubei (CN); Jia Zhang, Hubei (CN)

(73) Assignee: WUHAN CHINA STAR OPTOELECTRONICS SEMICONDUCTOR DISPLAY TECHNOLOGY CO., LTD, Wuhan (CN)

( * ) Notice: Subject to any disclaimer, the term of this patent is extended or adjusted under 35 U.S.C. 154(b) by 0 days.

(21) Appl. No.: 17/934,987

(22) Filed: Sep. 23, 2022

(30) Foreign Application Priority Data

Jul. 26, 2022 (CN) ..... 202210885590.5

(51) Int. Cl.
*G09G 3/3275* (2016.01)
*G09G 3/3266* (2016.01)

(52) U.S. Cl.
CPC ..... *G09G 3/3275* (2013.01); *G09G 3/3266* (2013.01); *G09G 2300/0828* (2013.01); *G09G 2310/0291* (2013.01); *G09G 2310/08* (2013.01)

(58) Field of Classification Search
CPC ..... G09G 3/3275
USPC ..... 345/214
See application file for complete search history.

(56) References Cited

U.S. PATENT DOCUMENTS

| | | | | |
|---|---|---|---|---|
| 2011/0069088 | A1* | 3/2011 | Weng | G09G 3/3688 345/213 |
| 2011/0109816 | A1* | 5/2011 | Kim | G09G 3/3614 348/792 |
| 2019/0005905 | A1* | 1/2019 | Chen | G09G 3/3618 |
| 2019/0088227 | A1* | 3/2019 | Matsumoto | G09G 3/3685 |
| 2019/0279589 | A1* | 9/2019 | Kusumi | G09G 3/3677 |

* cited by examiner

*Primary Examiner* — Long D Pham
(74) *Attorney, Agent, or Firm* — PV IP PC; Wei Te Chung; Zhigang Ma

(57) ABSTRACT

A data driver includes a buffer module and at least two data processing paths. The buffer module is configured to synchronously output image data corresponding to at least two rows of sub-pixels. Each of the at least two data processing paths is connected to the buffer module and a set of data lines and is configured to synchronously output a data signal corresponding to the image data to the at least two rows of sub-pixels.

14 Claims, 8 Drawing Sheets

DATA DRIVER AND DISPLAY DEVICE

CROSS REFERENCE TO RELATED APPLICATION

This application claims the priority of Chinese Patent Application No. 202210885590.5, entitled "DATA DRIVER AND DISPLAY DEVICE", filed on Jul. 26, 2022, the disclosure of which is incorporated herein by reference in its entirety.

FIELD OF THE DISCLOSURE

The present disclosure relates to a display technology, and more particularly, to a data driver and a display device.

BACKGROUND

Conventionally, a higher refresh frequency of displays in mass production is 144 Hz. As the development of the display technology and various client application scenarios, the demand for high-frequency display is getting stronger. However, in the research and development process of higher-frequency displays, it is found that with the increase of refresh frequency, the charging time of sub-pixels is more and more limited, and display problems such as poor visual effect caused by insufficient charging time are prone to occur.

SUMMARY

One objective of an embodiment of the present disclosure is to provide a data driver and a display device, to alleviate the issue of insufficient charging time in a higher-frequency display.

According to an embodiment of the present disclosure, a data driver is disclosed. The data driver comprises a buffer module and at least two data processing paths. The buffer module is configured to synchronously output image data corresponding to at least two rows of sub-pixels. Each of the at least two data processing paths is connected to the buffer module and a set of data lines and is configured to synchronously output a data signal corresponding to the image data to the at least two rows of sub-pixels.

Optionally, the buffer module comprises at least two line buffers connected in series. An output end of each of the line buffers is connected to an input end of one of the data processing paths, and each of the line buffers is configured to temporarily store image data corresponding to a row of sub-pixels.

Optionally, the data driver further includes a register that is configured to store a selection parameter. The selection parameter is configured to control a number of the data processing paths, which are in a working state, and/or a number of the line buffers, which are in a working state.

Optionally, the data driver further includes a counter connected to the buffer module. The counter is configured to calculate a row number of the image data temporarily stored in the buffer module to trigger the buffer module to output the image data.

Optionally, each of the data processing paths comprises a latch, a digital-to-analog converter (DAC), and a data mapping module. The latch has an input end connected to the buffer module. The latch is configured to row-by-row obtain the data image of a corresponding row of sub-pixels. The DAC has an input end connected to an output end of the latch. The data mapping module has an input end connected to an output end of the DAC. Each output end of the data mapping module is connected to a data line to output a corresponding data signal according to an arranged order.

Optionally, the data driver further comprises an amplifying module. Each input end of the amplifying module is connected to output ends of the at least two data processing paths and each output end of the amplifying module is correspondingly connected to at least two data lines.

According to an embodiment of the present disclosure, a display device is disclosed. The display device comprises the above-mentioned data driver. The data driver is used in a high-frequency display.

Optionally, the display device further comprises a plurality of sub-pixels arranged in an array, at least one set of scan lines connected to at least two rows of sub-pixels, and at least two sets of data lines. Each of the sets of data lines is connected to one row of the at least two rows of sub-pixels to synchronously provide data signals to the at least two rows of sub-pixels.

Optionally, a number of rows of sub-pixels connected to each set of scan lines is identical to a number of the at least two sets of two data lines.

Optionally, the at least two sets of data lines comprise odd data lines as a set of data lines and even data lines as another set of data lines. The odd data lines and the even data lines are alternatively arranged in a first direction. Each column of sub-pixels comprises odd sub-pixels and even sub-pixels alternatively arranged in a second direction. The odd sub-pixels are connected to the odd data lines and the even sub-pixels are connected to the even data lines or the odd sub-pixels are connected to the even data lines and the even sub-pixels are connected to the odd data lines.

Optionally, the display device further comprises a starting signal line and at least two gate drivers connected to the starting signal line. Each set of scan lines comprises at least two adjacent scan lines. One scan line of each set of scan lines is connected to one row of the at least two rows of sub-pixels and one of the two gate drivers. Another one of each set of scan lines is connected to another row of the at least two rows of sub-pixels and another one of the at least two gate drivers.

According to an embodiment of the present disclosure, the display driver and the display device could synchronize the image data corresponding to at least two rows sub-pixels through a buffer module. In this way, at least two data processing paths could synchronously output corresponding output signals to at least two rows of sub-pixels such that two rows of sub-pixels could be charged at the same time. In contrast to the conventional art, which charges the pixels row-by-row, the required charging time of the present disclosure under the same frequency is shorter and thus the present disclosure effectively alleviates the issue of insufficient charging time in a higher-frequency display.

BRIEF DESCRIPTION OF THE DRAWINGS

To describe the technical solutions in the embodiments of this application more clearly, the following briefly introduces the accompanying drawings required for describing the embodiments. Apparently, the accompanying drawings in the following description show merely some embodiments of this application, and a person of ordinary skill in the art may still derive other drawings from these accompanying drawings without creative efforts.

DETAILED DESCRIPTION

To help a person skilled in the art better understand the solutions of the present disclosure, the following clearly and completely describes the technical solutions in the embodiments of the present invention with reference to the accompanying drawings in the embodiments of the present invention. Apparently, the described embodiments are a part rather than all of the embodiments of the present invention. All other embodiments obtained by a person of ordinary skill in the art based on the embodiments of the present invention without creative efforts shall fall within the protection scope of the present disclosure.

Figure 1:
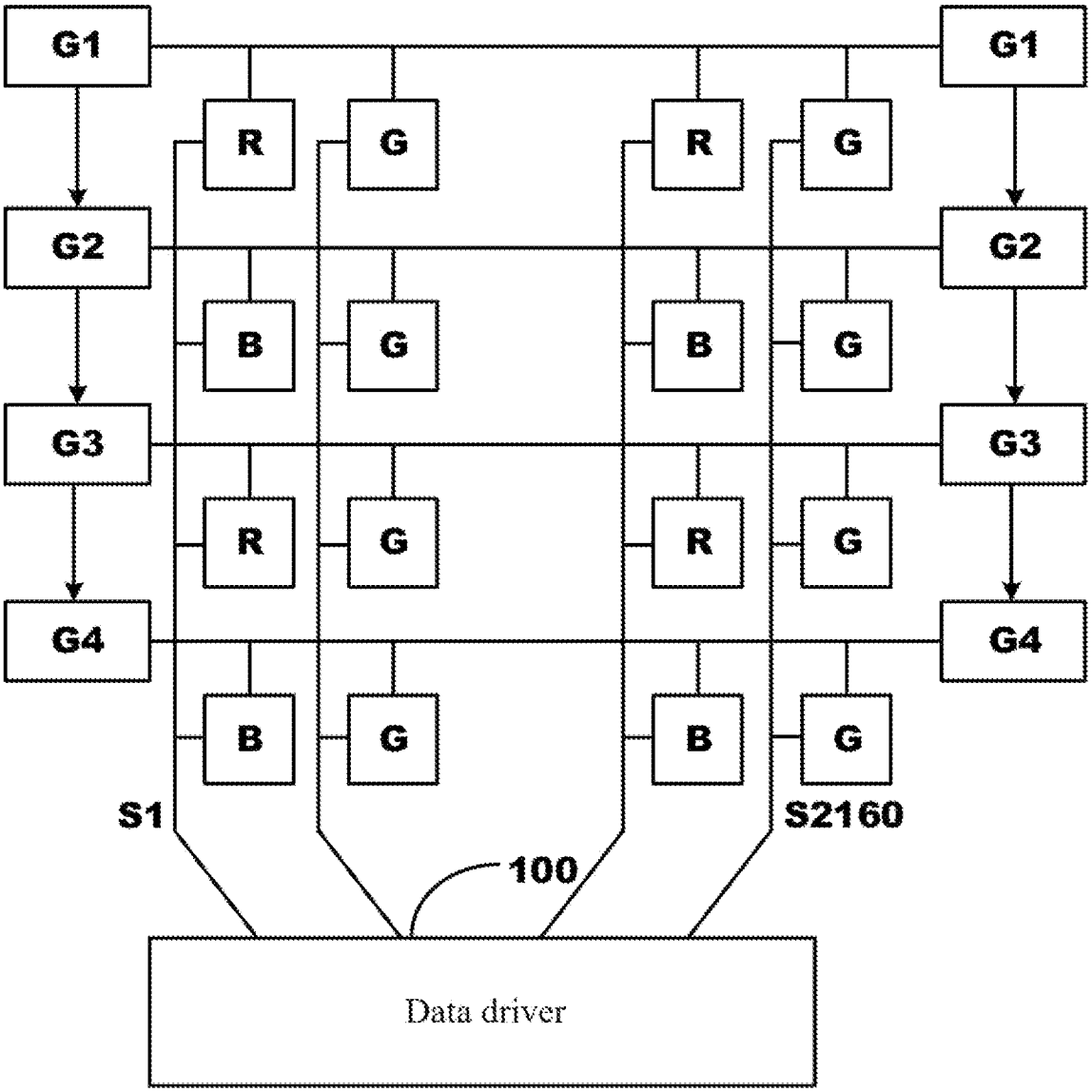
FIG. 1 a diagram of a conventional display device.

Please refer to FIG. 1. FIG. 1 a diagram of a conventional display device. The display device comprises a plurality of scan lines, a plurality of data lines, sub-pixels arranged in an array and a data driver 100. Here, the sub-pixels could include red sub-pixels R, blue sub-pixels B and green sub-pixels G.

Each scan line is connected to a row of sub-pixels to turn on the sub-pixels row-by-row. For example, a scan signal G1 is inputted into one end or two ends of the first scan line to turn on the first row of sub-pixels. The scan signal G2 is inputted into one end or two ends of the second scan line to turn on the second row of sub-pixels. The scan signal G3 is inputted into one end or two ends of the third scan line to turn on the third row of sub-pixels. The scan signal G4 is inputted into one end or two ends of the fourth scan line to turn on the fourth row of sub-pixels.

Each data line is connected to a column of sub-pixels to charge the sub-pixels column-by-column.

Each output end of the data driver 100 is correspondingly connected to one data line to provide corresponding data signals to each of the data lines. For example, if the display device has 2160 columns of sub-pixels, the display device has 2160 data lines and the data driver 100 needs to correspondingly provide the first data signal S1 to the $2160^{th}$ data signal S2160.

Figure 2:
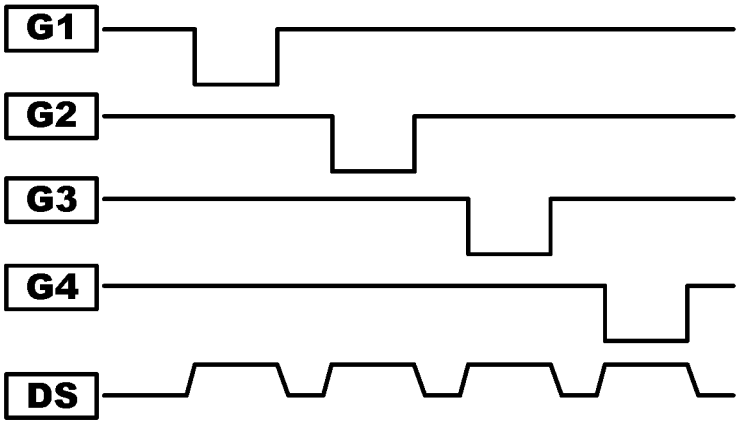
FIG. 2 is a diagram of driving timings of the display device shown in FIG. 1.

FIG. 2 is a diagram of driving timings of the display device shown in FIG. 1. When the scan signal row-by-row turn on the rows of sub-pixels, the data signal set DS sequentially charges each row of the sub-pixels. Here, the data signal set DS could comprise the above-mentioned first data signal S1 to the $2160^{th}$ data signal S210. For example, the scan signal G1 turns on the first row of sub-pixels during a negative impulse. At this time, the data signal set DS charges each sub-pixel in the first row. The scan signal G2 turns on the second row of sub-pixels during a negative impulse. At this time, the data signal set DS charges each sub-pixel in the second row. The scan signal G3 turns on the third row of sub-pixels during a negative impulse. At this time, the data signal set DS charges each sub-pixel in the third row. The scan signal G4 turns on the fourth row of sub-pixels during a negative impulse. At this time, the data signal set DS charges each sub-pixel in the fourth row. The driving timing of the other rows of sub-pixels is similar.

Figure 3:
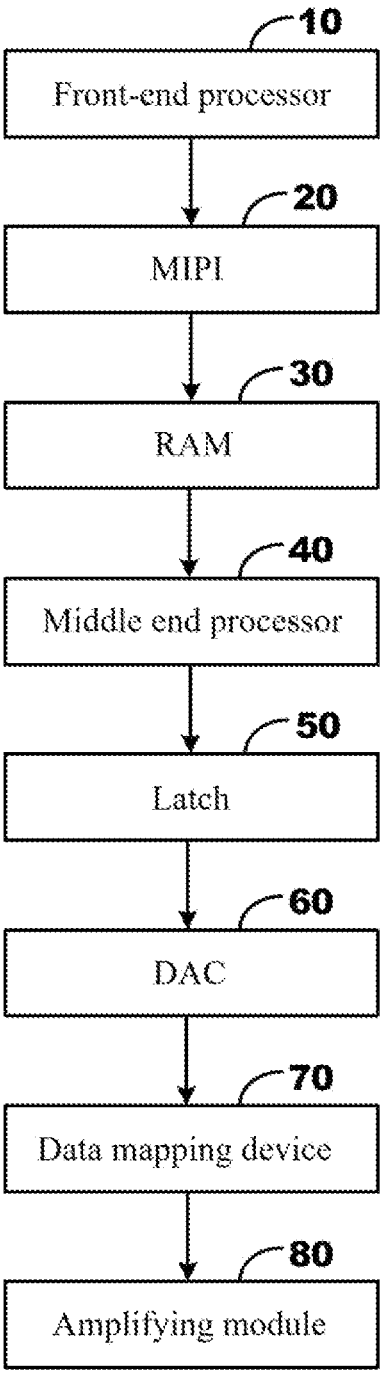
FIG. 3 is a diagram of the data driver shown in FIG. 1.

Correspondingly, the data driver 100 needs to have the structure shown in FIG. 3 to achieve the above-mentioned driving mechanism and driving timing. The data driver 100 comprises a front-end processor 10, a Mobile Industry Processor Interface (MIPI) 20, a random access memory 30, a middle end processor 40, a latch 50, a digital-to-analog converter (DAC) 60, a data mapping device 70 and an amplifying module 80. In this embodiment, the front-end processor 10 receives video data. The amplifying module 80 outputs a data signal to the corresponding data line.

Figure 6:
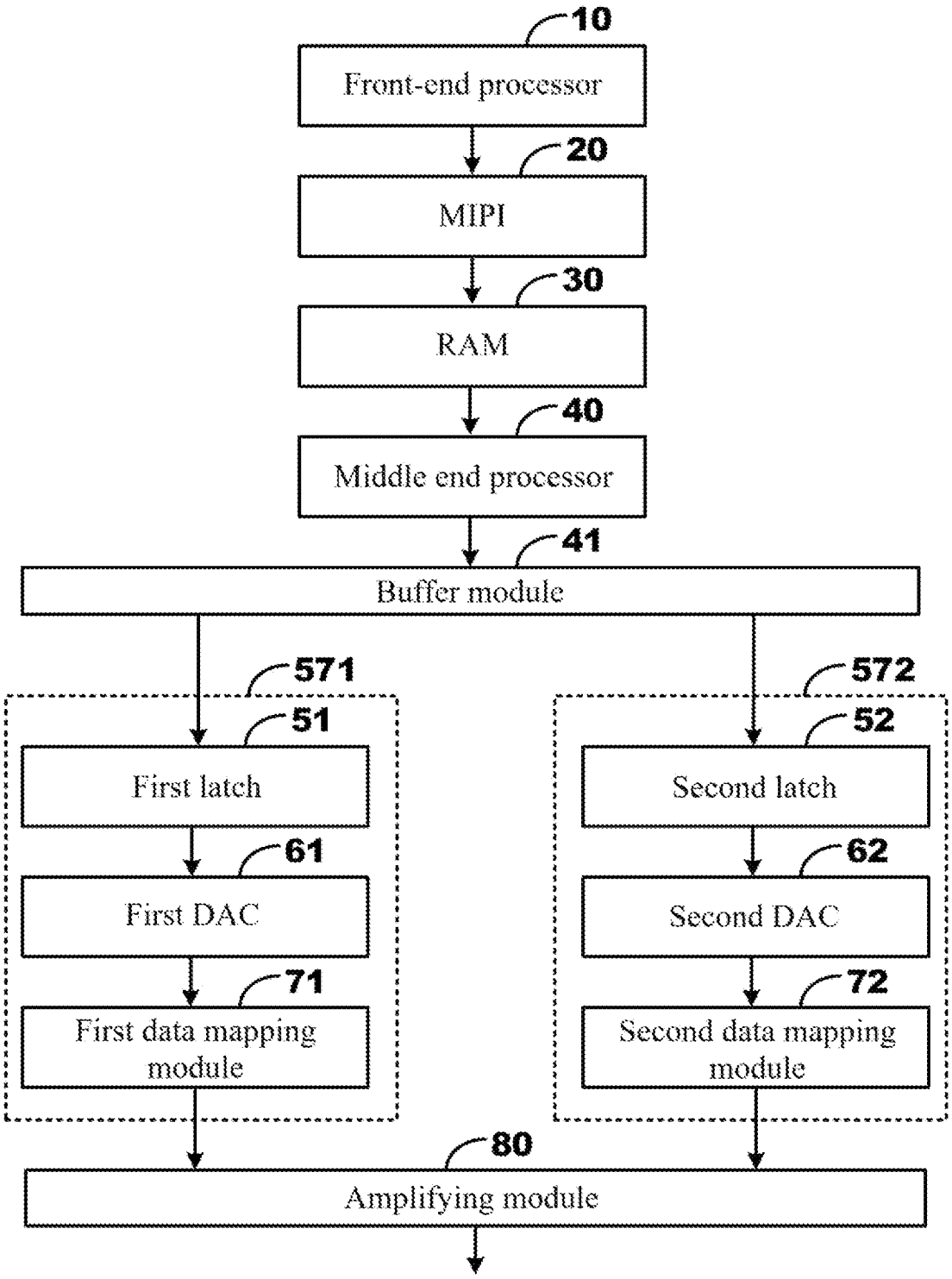
FIG. 6 is a diagram of the data driver shown in FIG. 4.

However, as the development of the high-frequency display, the above-mentioned driving mechanism and the driving timing become difficult to provide required charging time to the corresponding sub-pixels under a higher frequency display. Therefore, the present disclosure discloses a data driver 100. As shown in FIG. 6, the data driver 100 comprises a buffer module 41 and at least two data processing paths. The buffer module 41 is configured to synchronously output image data corresponding to at least two rows of sub-pixels. Each of the at least two data processing paths is connected to the buffer module 41 and a set of data lines. The at least two data processing paths are configured to synchronously output data signals corresponding to the received image data to the at least two rows of sub-pixels.

In contrast to the data driver 100 shown in FIG. 3, in this embodiment, the buffer module 41 and the data processing paths are further included. The buffer module 41 and the data processing paths could work together to synchronously process the image data processed by the middle-end processor 40 to synchronously output data signals to the corresponding data lines.

The display driver could synchronize the image data corresponding to at least two rows sub-pixels through a buffer module. In this way, at least two data processing paths could synchronously output corresponding output signals to at least two rows of sub-pixels such that two rows of sub-pixels could be charged at the same time. In contrast to the conventional art, which charges the pixels row-by-row, the required charging time of the present disclosure under the same frequency is shorter and thus the present disclosure effectively alleviates the issue of insufficient charging time in a higher-frequency display.

The input end of the buffer module 41 is connected to the output end of the middle-end processor 40.

Each of the data processing paths comprises a latch 50, a DAC 60 and a data mapping module 70. The input end of the latch 50 is connected to the buffer module 41 and is configured to row-by-row obtain the image data of corresponding row of sub-pixels. The input end of the DAC 60 is connected to the output end of the latch. The input end of the data mapping module 70 is connected to the output end of the DAC 60. Each output end of the data mapping end 70 and is configured to output corresponding data signals according to the arranged order.

For example, the first data processing path 571 could comprise a first latch 51, a first DAC 61 and a first data mapping module 71 connected in order. The second data processing path 572 could comprise a first latch 52, a first DAC 62 and a first data mapping module 72 connected in order. Here, the first latch 51 and the second latch 52 could have the same effect of the latch 50. The first DAC 61 and the second DAC 62 could have the same effect of the DAC 60. The first data mapping module 71 and the second data mapping module 72 could have the same effect of the data mapping module 70.

The number of the data processing paths could be the same as the number of the sets of data lines or the number of rows of sub-pixels connected to the same set of scan lines.

As shown in FIG. 6, the data driver 100 further comprises an amplifying module 80. Each input end of the amplifying module 80 is correspondingly connected to the output end of the at least two sets of data lines.

The input end of the amplifying module 80 is connected to the output end of each data mapping module 70. For example, the input end of the amplifying module 80 could be connected to the output end of the first data mapping module 71 and/or the second data mapping module 72. The amplifying module 80 could amplify the current and/or the voltage of the data signal to raise the driving capability of the data signal.

The data driver 100 further comprises a register 90. The register 90 stores a selection parameter. The selection parameter is configured to control a number of the data processing paths, which are in a working state, and/or a number of the line buffers, which are in a working state.

Figure 7:
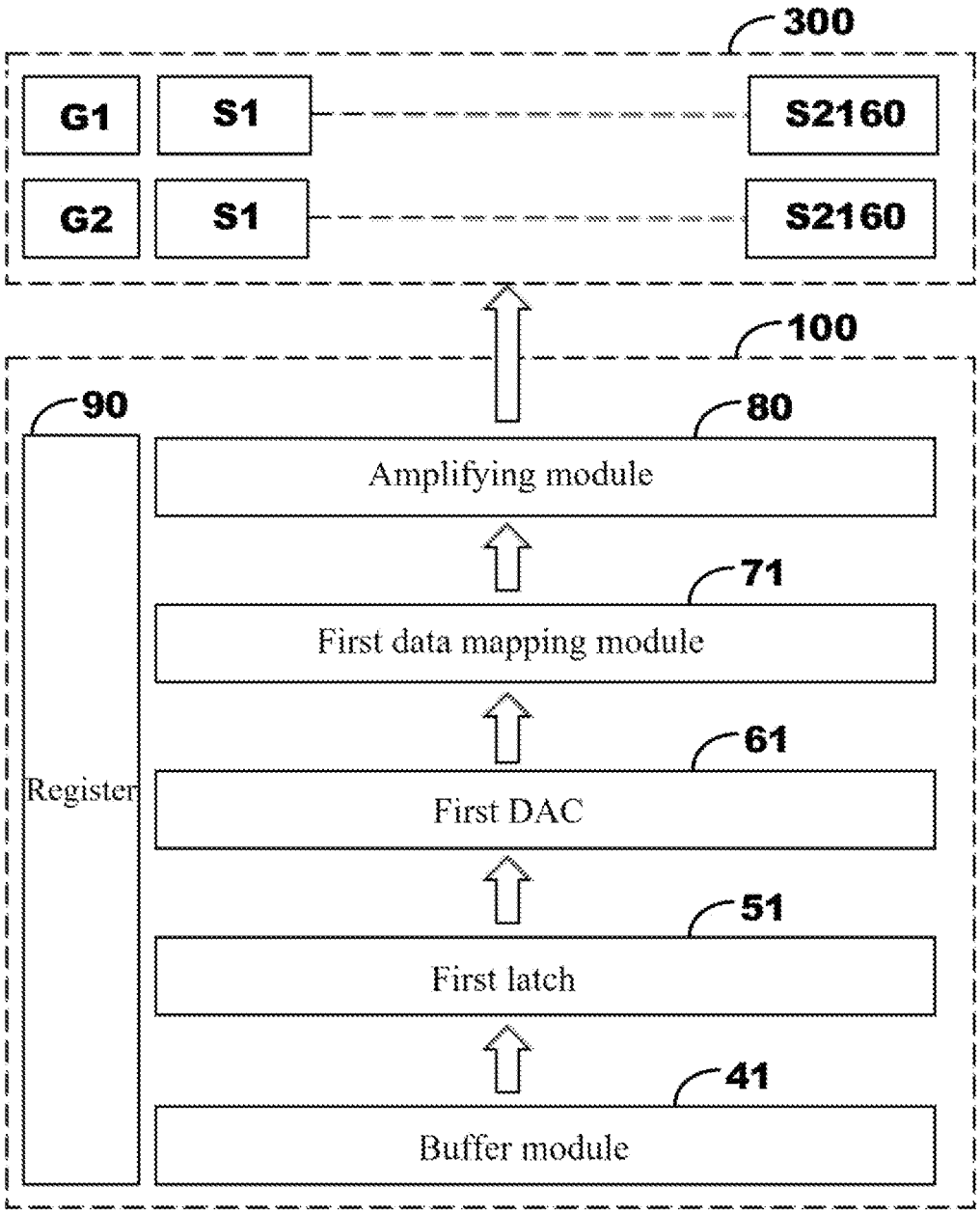
FIG. 7 is a diagram of a first work of a selection parameter of a register according to an embodiment of the present disclosure.

As shown in FIG. 7, the selection parameter could be a 2-bit parameter. When the 2-bit parameter is 00, the data driver 100 only has one data processing path in the working state. At this time, after the buffer module 41 receives the corresponding image data, the image data are processed by the latch 51, the first DAC 61, the first data mapping module 71 and the amplifying module 80 and then the data signals S1-S2160 are outputted to the corresponding sub-pixels of the display panel 300. And then, the corresponding sub-pixels are charged under the control of the scan signals G1, G2, etc. In this embodiment, the display panel 300 has 2160 columns of sub-pixels, as an example.

Figure 8:
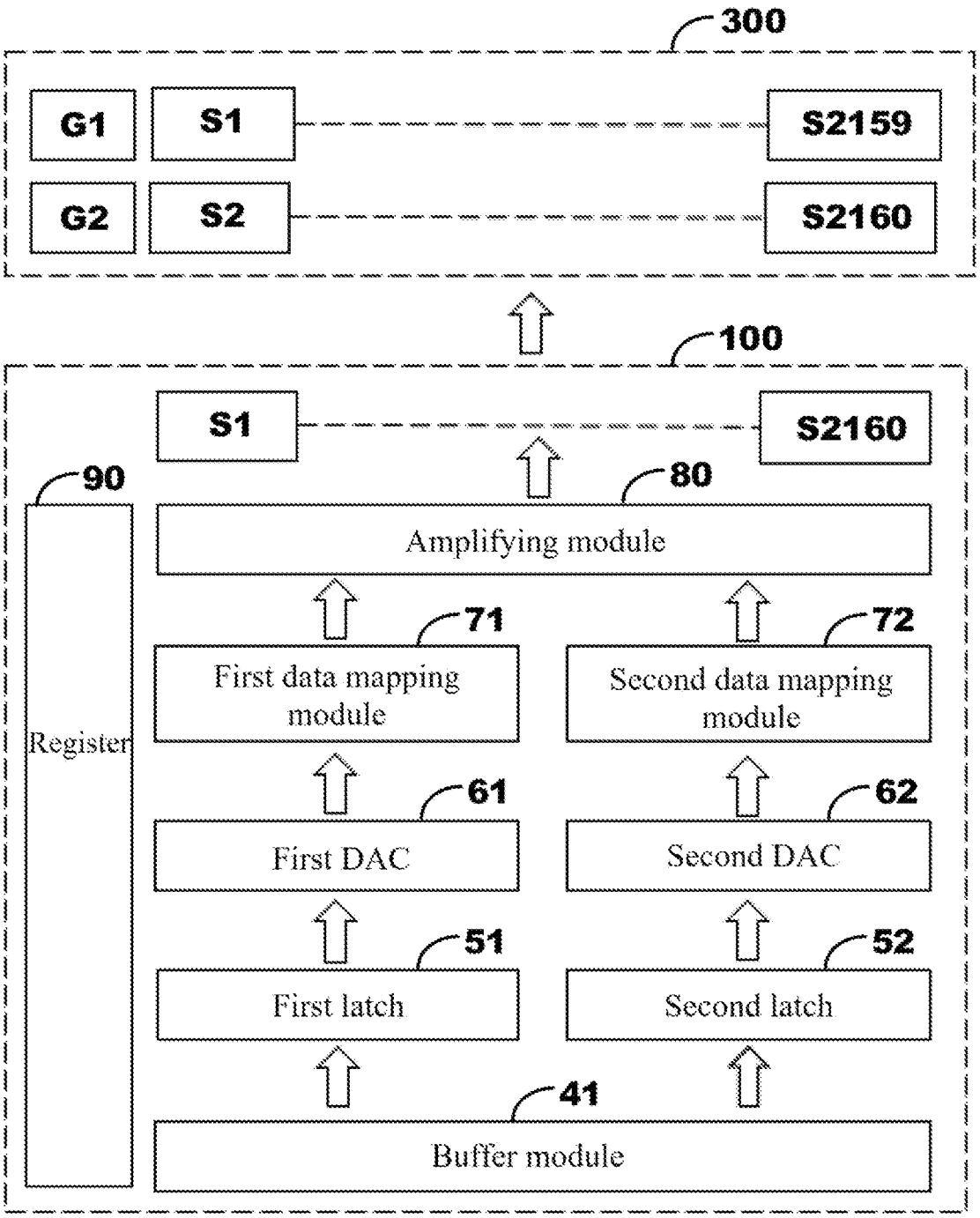
FIG. 8 is a diagram of a second work of a selection parameter of a register according to an embodiment of the present disclosure.

As shown in FIG. 8, the selection parameter could be a 2-bit parameter. When the 2-bit parameter is 01, the data driver 100 has two data processing paths in the working state. At this time, after the buffer module 41 receives the corresponding image data, the image data are processed by the first latch 51, the first DAC 61, the first data mapping module 71 and the amplifying module 80 and then the odd data signals S1-S2160 are outputted to the corresponding sub-pixels of the display panel 300. Furthermore, after the buffer module 41 receives the corresponding image data, the image data are processed by the second latch 52, the second DAC 62, the second data mapping module 72 and the amplifying module 80 and then the even data signals S1-S2160 are outputted to the corresponding sub-pixels of the display panel 300. And then, the corresponding sub-pixels are charged under the control of the scan signals G1, G2, etc. In this embodiment, the display panel 300 has 2160 columns of sub-pixels, as an example.

Similarly, the selection parameter could be a 2-bit parameter. When the 2-bit parameter is 10, the data driver 100 has three data processing paths in the working state. Or, when the 2-bit parameter is 11, the data driver 100 has four data processing paths in the working state.

The buffer module 41 comprises at least two series-connected line buffers. The output end of each line buffer is correspondingly connected to the input end of one data processing path. Each line buffer is configured to temporarily store corresponding image data.

The aforementioned selection parameter could be a 2-bit parameter. When the selection parameter is 00, then the number of the line buffers could be 0 or 1. When the selection parameter is 01, the number of the line buffers could be 2. When the selection parameter is 10, the number of the line buffers could be 3. When the selection parameter is 11, the number of the line buffers could be 4.

Figure 9:
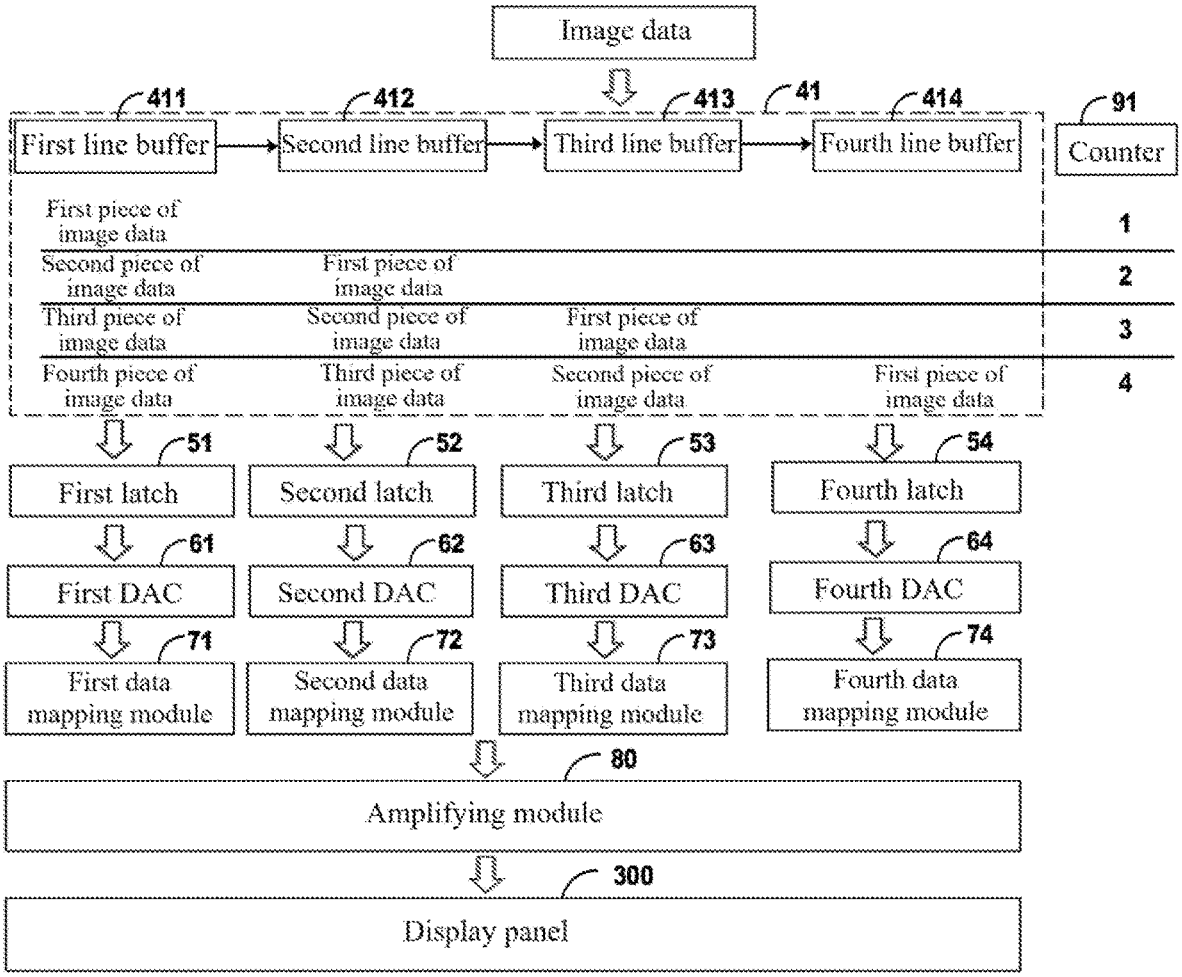
FIG. 9 is a diagram of the buffer module according to an embodiment of the present disclosure.

As shown in FIG. 9, when the selection parameter is 11, the data driver 100 comprises four data processing paths in the working state and four line buffers in the working state.

In contrast to FIG. 8, the input end of the first latch 51 is connected to the output end of the first line buffer 411, the input end of the second latch 52 is connected to the output end of the second line buffer 412, the input end of the third latch 53 is connected to the output end of the third line buffer 413, and the input end of the fourth latch 54 is connected to the output end of the fourth line buffer 414. Here, the third data processing path and the fourth data processing path are included. The third data processing path comprises series-connected the third latch 53, the third DAC 63 and the third data mapping module 73. The fourth data processing path comprises series-connected the fourth latch 54, the fourth DAC 64 and the fourth data mapping module 74.

The output end of the third data mapping 73 and the output end of the fourth data mapping module 74 are respectively connected to the input end of the amplifying module 80. And then, the amplifying module 80 amplifies the data signal and outputs the amplified data signal to the display panel.

The first piece of the image data outputted by the middle-end processor 40 first enters the first line buffer 411. Then, the second piece of the image data outputted by the middle-end processor 40 enters the first line buffer 411 and the first piece of the image data synchronously enters the second line buffer 412. And then, the third piece of the image data outputted by the middle-end processor 40 enters the first line buffer 411, the second piece of the image data synchronously enters the second line buffer 412, and the first piece of the image data synchronously enters the third line buffer 413. And then, the fourth piece of the image data outputted by the middle-end processor 40 enters the first line buffer 411, the third piece of the image data synchronously enters the second line buffer 412, the second piece of the image data synchronously enters the third line buffer 413 and the first piece of the image data synchronously enters the fourth line buffer 414. At this time, each line buffer stores a piece of image data and the counter 91 has counted to four such that the counter 91 knows that there are four pieces of data. This triggers the buffer module 41 to simultaneously output the four pieces of data to the data processing paths.

Each piece of image data could be one row or multiple rows of the image data or any part of the image data.

The data driver 100 further comprises a counter 91 connected to the buffer module 41. The counter 91 is configured to calculate a row number of the image data temporarily stored in the buffer module to trigger the buffer module to output the image data.

In addition, according to an embodiment, a display device is disclosed. The display device comprises the above-mentioned data driver, which is used in a higher-frequency display.

The display device could synchronize the image data corresponding to at least two rows sub-pixels through a buffer module 41. In this way, at least two data processing paths could synchronously output corresponding output signals to at least two rows of sub-pixels such that two rows of sub-pixels could be charged at the same time. In contrast to the conventional art, which charges the pixels row-by-row, the required charging time of the present disclosure under the same frequency is shorter and thus the present disclosure effectively alleviates the issue of insufficient charging time in a higher-frequency display.

The display device could be, but not limited to be, a self-lighting display device, such as an organic light emitting diode (OLED) display device, a micro-OLED display device, a mini-OLED display device, or a quantum-dot LED display device, or a liquid crystal display (LCD) device.

Figure 4:
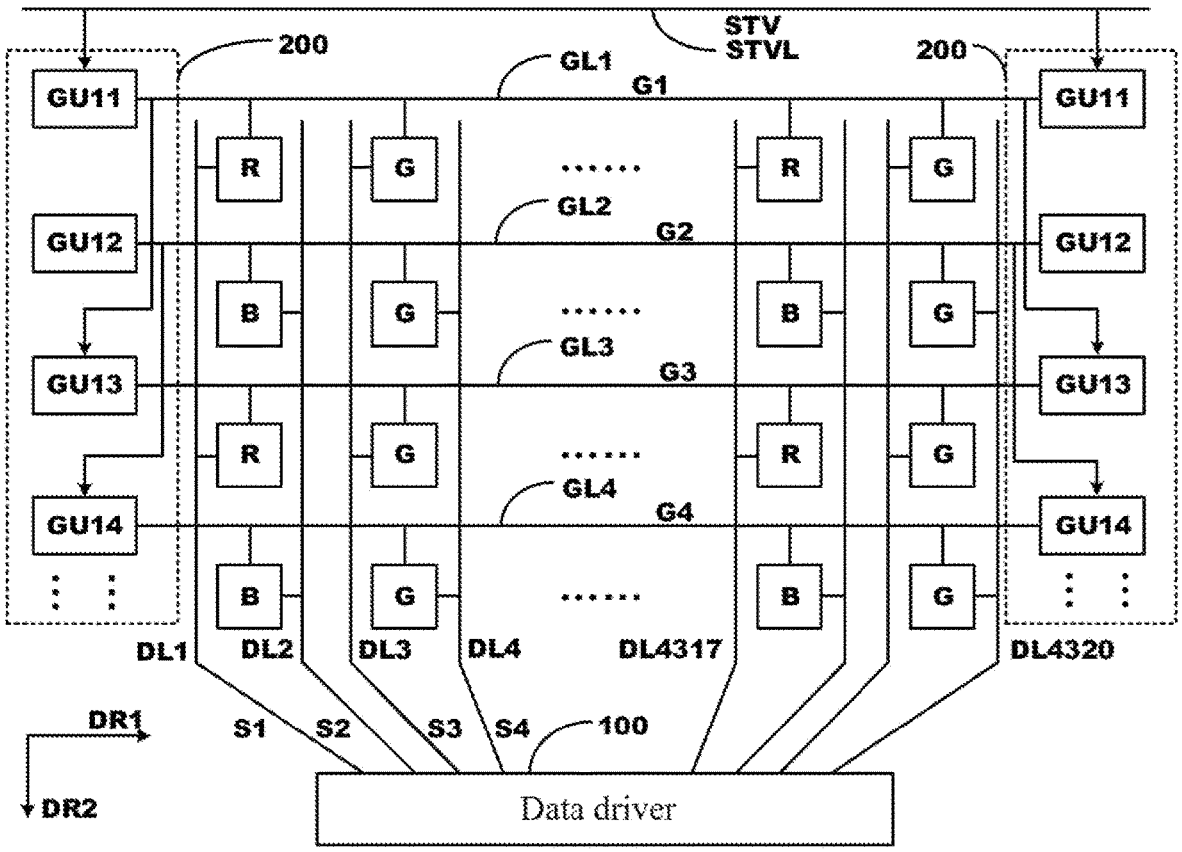
FIG. 4 is a diagram of a display device according to an embodiment of the present disclosure.
Figure 5:
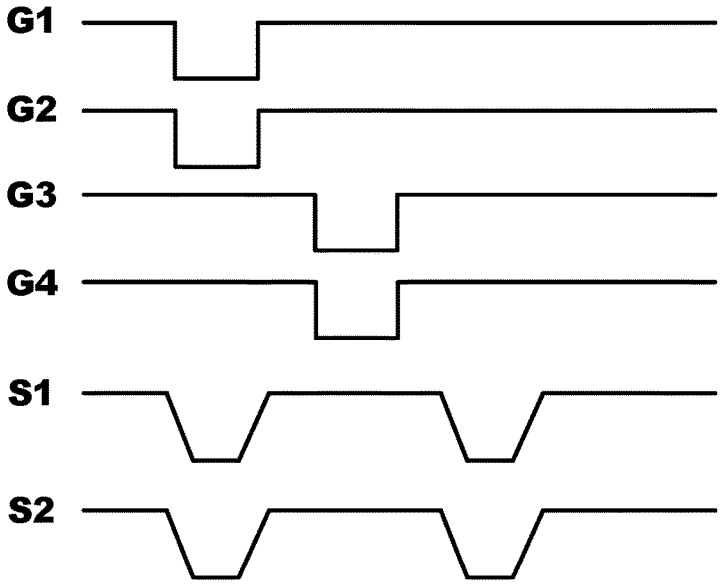
FIG. 5 is a diagram of driving timings of the display device shown in FIG. 4.

As shown in FIG. 4 and FIG. 5, the display device comprises a plurality of sub-pixels arranged in an array, at least one set of scan lines and at least two sets of data lines. Each set of scan lines is connected to at least two rows of sub-pixels. Each set of data lines is connected to one row of the at least two rows of sub-pixels to synchronously provide data signals to the at least two rows of sub-pixels.

The display device could synchronize the image data corresponding to at least two rows sub-pixels through a buffer module. In this way, at least two data processing paths could synchronously output corresponding output signals to at least two rows of sub-pixels such that two rows of sub-pixels could be charged at the same time. In contrast to the conventional art, which charges the pixels row-by-row, the required charging time of the present disclosure under the same frequency is shorter and thus the present disclosure effectively alleviates the issue of insufficient charging time in a higher-frequency display.

Each set of scan lines could have one or more scan lines. For example, the scan line GL1 could be a set of scan lines, which are connected to at least two rows of sub-pixels to synchronously turn on the at least two rows of sub-pixels. The scan line GL1 and the scan line GL2 could be a set of scan lines. Here, the scan line GL1 is connected to the first row of the sub-pixels to turn on the first row of sub-pixels. The scan line GL2 is connected to the second row of sub-pixels to turn on the second row of sub-pixels. The scan line GL3 and the scan line GL4 could be a set of scan lines. Here, the scan line GL3 is connected to the third row of sub-pixels to turn on the third row of sub-pixels. The scan line GL4 is connected to the fourth row of sub-pixels to turn on the fourth row of sub-pixels. The operations of the other set of scan lines are similar. Similarly, each set of scan lines could have three, four or more scan lines to synchronously turn on corresponding rows of sub-pixels.

Here, the scan lines in the same set could be adjacent or isolated. The scan lines in the same set could be connected to adjacent rows of sub-pixels or isolated rows of sub-pixels. Preferably, the scan lines in the same set are adjacent and connected to the adjacent rows of sub-pixels. In this way, cross sections of the wires in the display device 300 could be reduced and the layout distance could be reduced.

The at least two sets of data lines comprise odd data lines as a set of data lines and even data lines as another set of data lines. The odd data lines and the even data lines are alternatively arranged in a first direction DR1. Each column of sub-pixels comprises odd sub-pixels and even pixels, which are alternatively arranged in a second direction DR2. The odd sub-pixels are connected to the odd data lines or the even data lines. The even sub-pixels are connected to the even data lines when the odd sub-pixels are connected to the odd data lines. Or, the even sub-pixels are connected to the odd data lines when the odd sub-pixels are connected to the even data lines.

As shown in FIG. 4, two sets of data lines are included. One set of data lines is the odd data lines, such as data line DL1, data line DL3, . . . , data line DL4317. The set of data lines provides corresponding data signals to the odd rows of sub-pixels, such as the first row, the third row, etc. The other set of data lines is the even data lines, such as data line DL2, data line DL4, . . . , data line DL4320. The set of data lines provides corresponding data signals to the even rows of sub-pixels, such as the second row, the fourth row, etc. Or, the odd data lines could be connected to the even rows of sub-pixels and the even data lines could be connected to the odd rows of sub-pixels.

The data line DL1 is configured to transfer the data signal S1 sent from the data driver 100. The data line DL2 is configured to transfer the data signal S2 sent from the data driver 100. The data line DL3 is configured to transfer the data signal S3 sent from the data driver 100. The data line DL4 is configured to transfer the data signal S4 sent from the data driver 100.

In some embodiments, three sets of data lines could be adopted. One set of the data lines could provide corresponding data signals to some rows of sub-pixels, such as the $1^{st}$, $4^{th}$, $7^{th}$, . . . etc. Another set of the data lines could provide corresponding data signals to some other rows of sub-pixels, such as the $2^{nd}$, $5^{th}$, $8^{th}$, . . . etc. The other set of the data lines could provide corresponding data signals to the other rows of sub-pixels, such as the $3^{rd}$, $6^{th}$, $9^{th}$, . . . etc.

In the above embodiment, each frame has shorter time in a higher frequency display. If there are more sets of data lines, the required write-in time of the data signals in one frame becomes shorter. In this way, the time required for charging the corresponding sub-pixels in one frame could be met.

As shown in FIG. 4, the display device further comprises a starting signal line STVL and at least two scan drivers 200. The starting signal line STVL is connected to at least two scan drivers 200. Each set of scan lines comprises at least two adjacent scan lines. One scan line of each set of scan lines is connected to one row of the at least two row of sub-pixels and one of the two scan drivers 200. Another scan line of each set of scan lines is connected to another row of the at least two row of sub-pixels and another of the two scan drivers 200.

In this embodiment, two scan drivers 200 are respectively disposed at the right and left sides of the display area and are able to provide the scan signals to the same scan line. Here, each scan driver 200 comprises cascaded scan driving units, such as the gate driving units GU11, GU12, GU13, GU14, etc. The gate driving unit GU11 and the gate driving unit GU13 are cascaded. The gate driving unit GU12 and the gate driving unit GU14 are cascaded and so on.

The two ends of the scan line GL1, for transferring the scan signal G1, are respectively connected to the two gate drivers GU11. The two ends of the scan line GL2, for transferring the scan signal G2, are respectively connected to the two gate drivers GU12. The two ends of the scan line GL3, for transferring the scan signal G3, are respectively connected to the two gate drivers GU13. The two ends of the scan line GL4, for transferring the scan signal G1, are respectively connected to the two gate drivers GU14 and so on. In this way, the transmission loss of each scan signal in the corresponding scan line could be reduced and thus the driving capability of the scan signals could be raised.

The starting signal line STVL is configured to transfer a starting signal STV. The starting signal STV could control two gate drivers 200 to synchronously work and output the same scan signals.

The above display device could adopt one scan driver 200. This configuration could also achieve the same driving timing of the display device having two scan drivers 200. In this way, a scan driver 200 is reduced and the side frame space of the display device could be reduced.

FIG. 5 is a diagram of driving timings of the display device shown in FIG. 4. The scan signal G1 and the scan signal G2 have the same waveform and simultaneously turn on the first row of sub-pixels and the second row of sub-pixels in the duration of their negative impulses. In the duration, the data signals of the corresponding sets are simultaneously written into the first row and the second row of sub-pixels. For example, the data signals S1 . . . transferred by the odd data lines are written into the first row of sub-pixels and the data signals S2 . . . transferred by the even data lines are written into the second row of sub-pixels. And then, the negative impulses of the scan signals G3 and G4 having the same waveform comes, the corresponding data signals are simultaneously written to the third row and the fourth row of sub-pixels. This scan operation continues until all the sub-pixels are completely charged. Under the same refresh rate, a half charging time in a frame could be reduced. Similarly, if data signals are simultaneously written into more rows, more charging time in a frame could be reduced.

The number of rows of sub-pixels connected to each set of scan lines is identical to the number of the sets of two data lines.

In this embodiment, each set of data lines charges a row of sub-pixels. As the number of the sets of scan lines or the number of rows of sub-pixels connected to each set of scan lines increase, data signals are simultaneously written into more rows of sub-pixels. This could reduce more charging time in a frame.

In the above embodiments, the description of one embodiment may have its focuses. Therefore, if a part of the certain embodiment is not described in details, a person having ordinary skills in the art could refer to another embodiment to understand the part.

Above are embodiments of the present disclosure, which does not limit the scope of the present disclosure. Any modifications, equivalent replacements or improvements within the spirit and principles of the embodiment described above should be covered by the protected scope of the disclosure.

What is claimed is:

1. A data driver, comprising:

a buffer module, configured to synchronously output image data corresponding to at least two rows of sub-pixels;

a counter, connected to the buffer module, configured to calculate a row number of the image data temporarily stored in the buffer module to trigger the buffer module to output the image data; and at least two data processing paths, wherein each of the at least two data processing paths is connected to the buffer module and a set of data lines, and the at least two data processing paths are configured to synchronously output data signals corresponding to the image data to the at least two rows of sub-pixels.

2. The data driver of claim 1, wherein the buffer module comprises at least two line buffers connected in series, an output end of each of the line buffers is connected to an input end of one of the data processing paths, and each of the line buffers is configured to temporarily store image data corresponding to a row of sub-pixels.

3. The data driver of claim 2, further comprising:

a register, configured to store a selection parameter;

wherein the selection parameter is configured to control a number of the data processing paths, which are in a working state, and/or a number of the line buffers, which are in a working state.

4. The data driver of claim 1, wherein each of the data processing paths comprises:

a latch, having an input end connected to the buffer module, wherein the latch is configured to row-by-row obtain the data image of a corresponding row of sub-pixels;

a digital-to-analog converter (DAC), having an input end connected to an output end of the latch; and a data mapping module, having an input end connected to an output end of the DAC, wherein each output end of the data mapping module is connected to a data line to output a corresponding data signal according to an arranged order.

5. The data driver of claim 1, further comprising:

an amplifying module, wherein each input end of the amplifying module is connected to output ends of the at least two data processing paths and each output end of the amplifying module is correspondingly connected to at least two data lines.

6. A display device, comprising a data driver used in a high-frequency display, the data driver comprising:

a buffer module, configured to synchronously output image data corresponding to at least two rows of sub-pixels;

a counter, connected to the buffer module, configured to calculate a row number of the image data temporarily stored in the buffer module to trigger the buffer module to output the image data; and at least two data processing paths, wherein each of the at least two data processing paths is connected to the buffer module and a set of data lines, and the at least two data processing paths are configured to synchronously output data signals corresponding to the image data to the at least two rows of sub-pixels.

7. The display device of claim 6, wherein the buffer module comprises at least two line buffers connected in series, an output end of each of the line buffers is connected to an input end of one of the data processing paths, and each of the line buffers is configured to temporarily store image data corresponding to a row of sub-pixels.

8. The display device of claim 7, wherein the data driver further comprises:

a register, configured to store a selection parameter;

wherein the selection parameter is configured to control a number of the data processing paths, which are in a working state, and/or a number of the line buffers, which are in a working state.

9. The display device of claim 6, wherein each of the data processing paths comprises:

a latch, having an input end connected to the buffer module, wherein the latch is configured to row-by-row obtain the data image of a corresponding row of sub-pixels;

a digital-to-analog converter (DAC), having an input end connected to an output end of the latch; and a data mapping module, having an input end connected to an output end of the DAC, wherein each output end of the data mapping module is connected to a data line to output a corresponding data signal according to an arranged order.

10. The display device of claim 6, wherein the data driver further comprises:

an amplifying module, wherein each input end of the amplifying module is connected to output ends of the at least two data processing paths and each output end of the amplifying module is correspondingly connected to at least two data lines.

11. The display device of claim 6, further comprising:

a plurality of sub-pixels arranged in an array;

at least one set of scan lines, connected to at least two rows of sub-pixels; and at least two sets of data lines, each of the sets of data lines is connected to one row of the at least two rows of sub-pixels to synchronously provide data signals to the at least two rows of sub-pixels.

12. The display device of claim 11, wherein a number of rows of sub-pixels connected to each set of scan lines is identical to a number of the at least two sets of two data lines.

13. The display device of claim 11, wherein the at least two sets of data lines comprise odd data lines as a set of data lines and even data lines as another set of data lines, the odd data lines and the even data lines are alternatively arranged in a first direction;

wherein each column of sub-pixels comprises odd sub-pixels and even sub-pixels alternatively arranged in a second direction, the odd sub-pixels are connected to the odd data lines and the even sub-pixels are connected to the even data lines or the odd sub-pixels are connected to the even data lines and the even sub-pixels are connected to the odd data lines.

14. The display device of claim 11, further comprising:

a starting signal line; and at least two gate drivers, connected to the starting signal line;

wherein each set of scan lines comprises at least two adjacent scan lines, one scan line of each set of scan lines is connected to one row of the at least two rows of sub-pixels and one of the two gate drivers; and another one of each set of scan lines is connected to another row of the at least two rows of sub-pixels and another one of the at least two gate drivers.

* * * * *